US005320037A

United States Patent [19]

Harris

[11] Patent Number: 5,320,037

[45] Date of Patent: Jun. 14, 1994

[54] ENCLOSED INK CUP FOR PAD-TYPE PRINTING MACHINE

[75] Inventor: Kenneth R. Harris, Byfield, Mass.

[73] Assignee: Imtran Industries, Inc., Rowley, Mass.

[21] Appl. No.: 952,298

[22] Filed: Sep. 28, 1992

[51] Int. Cl.[5] ..... B41F 17/00

[52] U.S. Cl. ..... 101/163; 101/169

[58] Field of Search ..... 101/35, 41, 44, 150, 101/151, 154, 155, 157, 163–166, 167, 169; 118/413

[56] References Cited

U.S. PATENT DOCUMENTS

| | | | |
|---|---|---|---|
| 3,742,902 | 7/1973 | Heston, Jr. | 101/129 |
| 4,557,195 | 12/1985 | Phlipp | 101/163 |
| 4,876,982 | 10/1989 | Claasen | 118/413 |
| 4,905,594 | 3/1990 | Phillip et al. | 101/163 |

FOREIGN PATENT DOCUMENTS

| | | | |
|---|---|---|---|
| 2205430 | 6/1981 | Fed. Rep. of Germany | 101/163 |

*Primary Examiner*—Edgar S. Burr
*Assistant Examiner*—Stephen R. Funk
*Attorney, Agent, or Firm*—Fish & Richardson

[57] ABSTRACT

An enclosed ink cup for a pad-type printing machine including a hollow support having a continuous wall surrounding and defining a reservoir region and an opening to the reservoir region at the bottom of the region, and a continuous, sheet metal band disposed around and conforming to an outer vertical surface of the wall, the band having a lower portion extending below the hollow support for sealably contacting an engraved printing plate so as to contain ink within the band over said plate.

20 Claims, 2 Drawing Sheets

ENCLOSED INK CUP FOR PAD-TYPE PRINTING MACHINE

BACKGROUND OF THE INVENTION

The invention relates to enclosed ink cups for pad-type printing machines.

On pad-type printing machines, an image engraved in a metal plate is provided with a thin film of ink by an ink cup that is slid over the surface of the plate. A doctor blade on the cup wipes the engraved surface as the ink cup is moved from the engraved area of the plate, leaving the ink at only the engraved image. A silicone pad then transfers the ink image from the plate to the object being printed. Typically the printing machines have used ink wells that are open to the atmosphere, and there have been recent environmental and health concerns related to vapors evaporating from the exposed ink.

In response to these concerns, enclosed ink cups have been proposed. For example, Phillip et al. U.S. Pat. No. 4,905,594 describes an enclosed ink cup that has a hollow body that can be bent in the area of its end face and employs a bellows structure to permit relative movement between the area of the end face and the remaining part of the hollow body in order to provide a sealable contact between the ink cup and the printing plate surface on printing plates whose surfaces exhibit deviations from a plane. Phlipp U.S. Pat. No. 4,557,195 describes an enclosed ink cup having a two-piece hollow body. The two parts are movable in relation to each other to ensure exact abutment on the printing plate surface independent of production tolerances.

SUMMARY OF THE INVENTION

The invention features, in general, an enclosed ink cup for a pad-type printing machine that includes a hollow support defining a reservoir region and a continuous, sheet metal band disposed around and conforming to the outer surface of the hollow support and extending below the bottom surface of the hollow support. The continuous band has a lower edge that sealably contacts the engraved printing plate. The band will wear to accommodate any angular difference in the orientation between the upper surface of the printing plate and the ink cup, providing a good seal all the way around. The band tends to wear more than the printing plate, prolonging the life of the printing plate, and the band can be simply replaced after it has worn out.

In preferred embodiments, the cup includes a band adjustment member that is mounted for vertical movement in order to vertically adjust the position of the band, for example, after the band has exhibited some wear in order to extend the life of the band. The band adjustment member moves over the outer surface of the hollow support and engages the top of the band at a lower surface of the adjustment member. The hollow support and the band adjustment member are cylindrical and have mating helical threads so that rotation of the band adjustment member moves the band vertically. The outer surface of the hollow support has a continuous groove that receives a sealing ring between it and the band in order to permit the band to have a sliding fit and to provide a good seal between the hollow support and the band. The hollow support has an opening at its top that is covered with a cap member, and the cap member is sealed to the hollow support via a sealing ring. The cap member has an opening through it and a plug in the opening. The band can additionally be used with oval shaped hollow supports, permitting larger engraved areas to be used on smaller plates.

Other advantages and features of the invention will be apparent from the following description of the preferred embodiment thereof and from the claims.

DESCRIPTION OF THE PREFERRED EMBODIMENT

The preferred embodiment will now be described.

DRAWINGS

Structure

Figure 1:
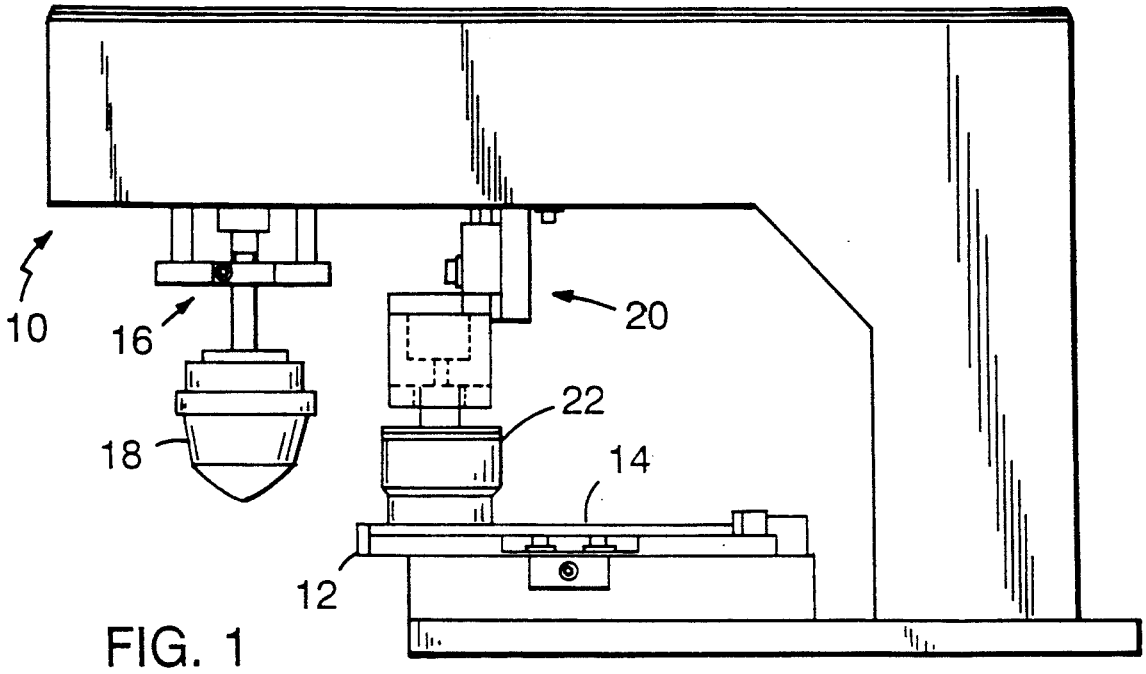
FIG. 1 is an elevation of a pad-type printing machine including an enclosed ink cup according to the invention.

Referring to FIG. 1, there is shown pad-type printing machine 10. It includes printing plate support 12 for supporting engraved printing plate 14 thereon, pad transport mechanism 16 for transporting pad 18, and ink cup transport mechanism 20 for sliding enclosed ink cup 22. Pad transport mechanism 16 moves pad 18 in both vertical and horizontal directions. Transport mechanism 20 moves ink cup 22 only in a horizontal direction, sliding ink cup 22 across the upper surface of printing plate 14, and applies a controlled downward pressure to ink cup 22.

Figure 2:
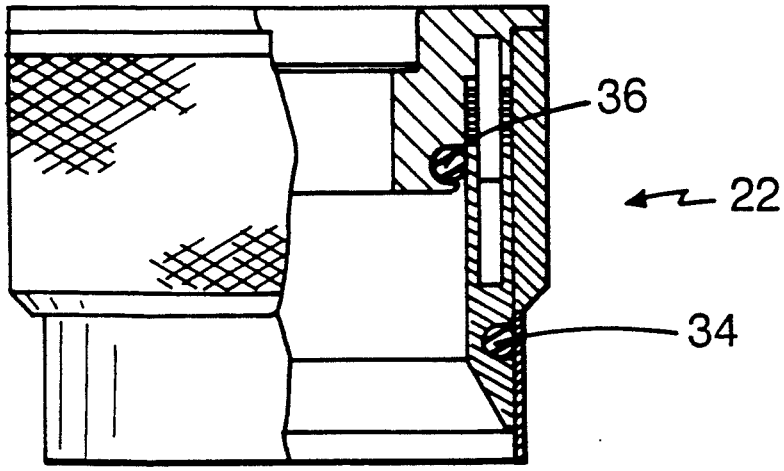
FIG. 2 is an elevation, partially in section, of the enclosed ink cup of the FIG. 1 printing machine.
Figure 3:
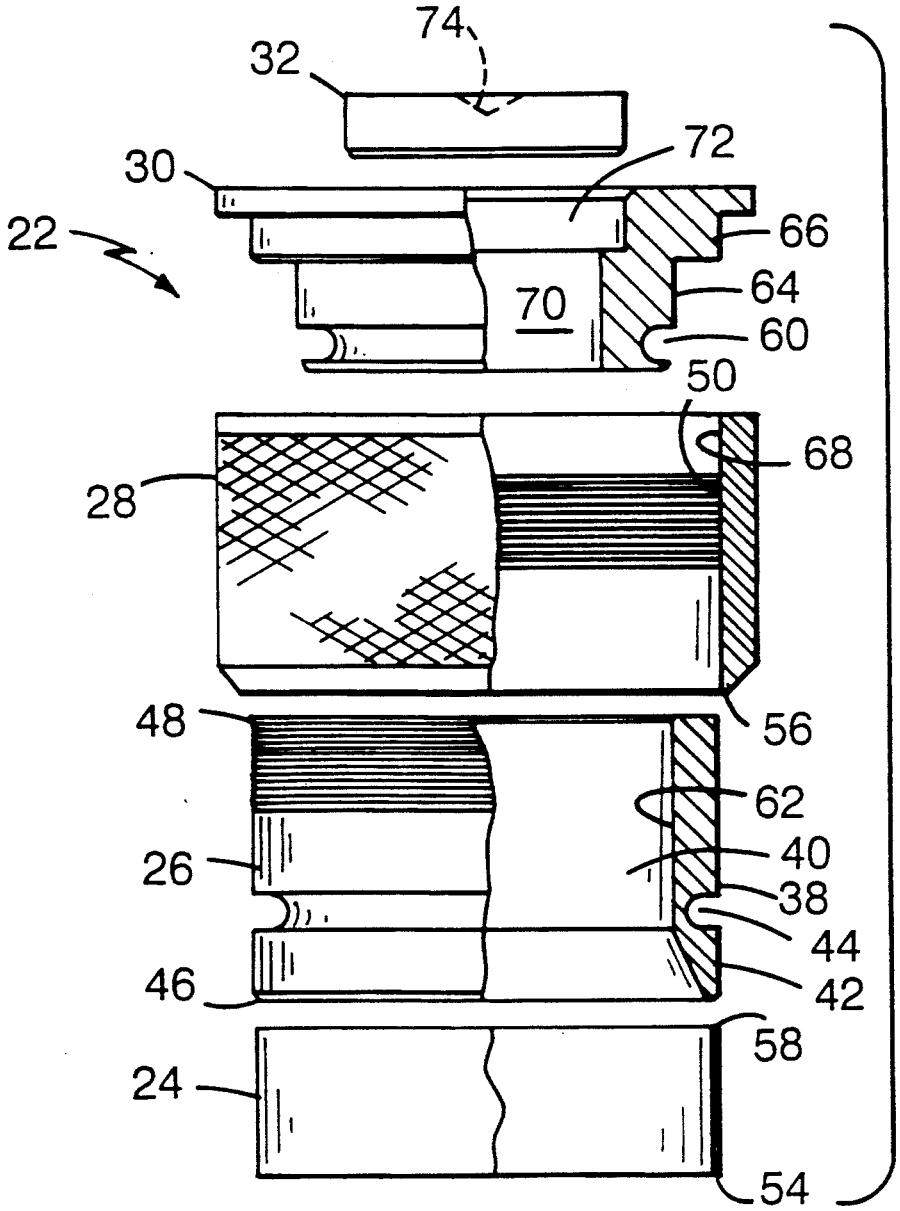
FIG. 3 is an exploded view, partially in section, of the FIG. 2 ink cup.

Referring to FIGS. 2 and 3, enclosed ink cup 22 includes continuous, sheet metal band 24, hollow support member 26, band adjustment member 28, cap member 30, plug 32, and elastomeric sealing rings 34, 36. Hollow support 26 has continuous cylindrical wall 38 surrounding and defining reservoir region 40 therein. Wall 38 has a continuous, vertical outer surface 42 having annular groove 44 therein in which sealing ring 34 is located. The outside diameter of surface 42 is 1.496". Wall 38 also has a bottom surface 46 surrounding an opening to reservoir region 40. External threads 48 at the upper portion of hollow support 26 mate with internal threads 50 of band adjustment member 28.

Sheet metal band 24 has lower portion 52 that extends below bottom surface 46 of hollow support 26. It also has a lower edge surface 54 for making sealable contact on the upper surface of printing plate 14. Band 24 is disposed around and conforms to the shape of outer surface 42. Band 24 has an inside diameter that is slightly larger than the outside diameter of surface 42 in order to provide a slip fit over it. A seal between hollow support 26 and the inner surface of band 24 is provided by elastomeric sealing ring 34. Band 24 is made of material having sufficiently low hardness so as to preferentially wear vis-a-vis the upper surface of engraved printing plate 14 and ink cup 22. This causes band 24 to wear in use more on one side than another in order to correct for angular mismatch of the upper surface of printing plate 14-vis-a-vis the orientation of ink cup 22. It also protects the engraved surface from premature wear and extends the life of the printing plate. Two examples of materials that can be used for band 54 are 301 stainless steel, 0.005 " thick, 0.750" wide, 1.500" inside diameter, hardness of 38–42 Rc (Rockwell harness) and 301 high-yield stainless steel of the same dimensions and a hardness of 50–52 Rc, both available from Belt Technologies, Agawam, Mass. Other thickness materials, e.g., preferably between 0.002" and 0.008" thick and of hardness to provide preferential wear of the band vis-a-vis the printing plate (e.g., between about 30 and 60 Rc) can be used.

Band adjustment member 28 has lower horizontal annular surface 56 that has an inside diameter of 1.500" and engages upper surface 58 of band 24. Cap member 30 has annular groove 60 which receives sealing ring 36 and provides a seal between cap 30 and the interior cylindrical surface 62 of hollow support 26. Sealing ring 36 prevents the ink in reservoir region 40 from contacting threads 48, 50. Cap member 30 has cylindrical surface 64 that fits within surface 62 of hollow support 26 and cylindrical surface 66 which fits within the upper cylindrical surface 68 of band adjustment member 28.

Cap member 20 has opening 70 therethrough permitting access to reservoir region 40 and has stepped annular recess 72 for receiving plug 32. Plug 32 has recess 74 in its upper surface for engagement by transport mechanism 20.

Operation

In operation, reservoir region 40 is filled with ink, and pad transport mechanism 16 and ink cup transport mechanism 20 move in coordinated fashion to cause ink cup 22 to provide a thin film of ink on the engraved area of plate 14 and to cause pad 18 to pick up the ink image and transfer it to the object being printed.

Figure 4:
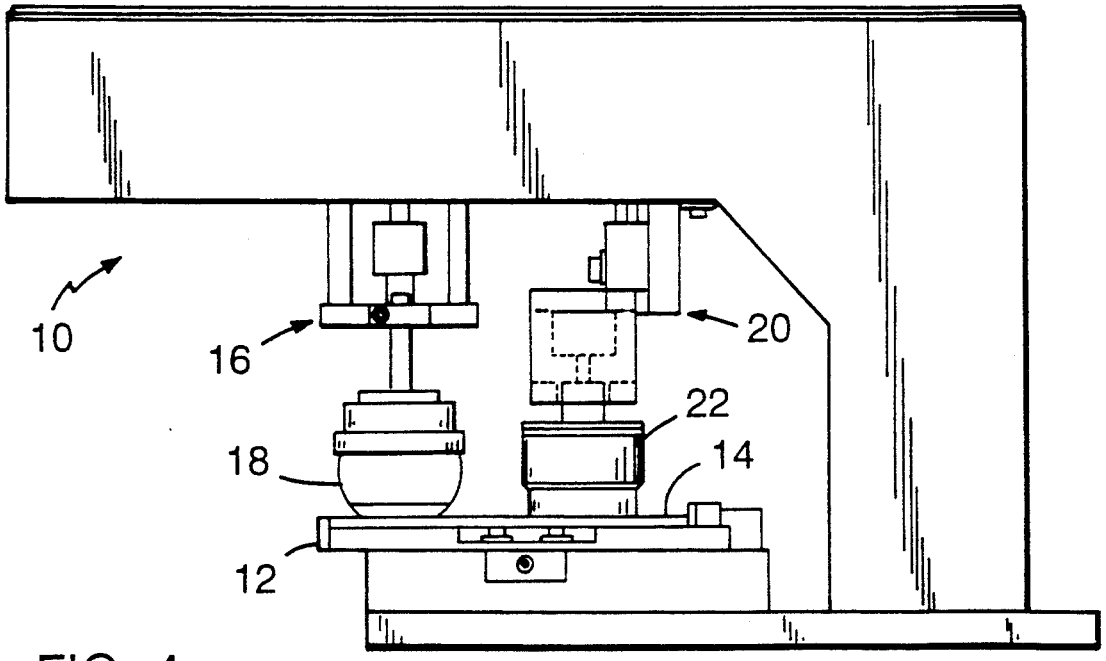
FIG. 4 is an elevation of the FIG. 1 printing machine shown with its ink cup and pad in different positions.

In the position shown in FIG. 1, ink cup 22 is over the engraved area of printing plate 14. Ink cup transport mechanism 20 then slides ink cup 22 to the right to the position shown in FIG. 4. During this sliding operation, lower edge 54 of band 24 wipes the upper surface of printing plate 14, leaving a thin film of ink on the engraved areas only. Simultaneously with the horizontal movement of transport mechanism 20 and ink cup 22, transport mechanism 16 moves pad 18 horizontally to a position over the engraved area and then vertically lowers pad 18 to the position shown in FIG. 4 in order to pick up the ink image.

Transport mechanism 16 then raises pad 18 and moves to the left to the position shown in FIG. 1 and then vertically lowers pad 18 onto the object (not shown) being printed. While transport mechanism 16 is moving to the left, transport mechanism 20 moves ink cup 22 to the left in order to expose the engraved area to ink to provide ink for the next image to be transferred.

The angular orientation of the upper surface of printing plate 14 -vis-a-vis the orientation of ink cup 22 will be accommodated by band 54 by wearing on one side. Transport mechanism 20 includes a pressure mechanism to provide a controlled downward pressure on ink cup 22, providing a good sealable contact and good wiping action but avoiding excessive pressure that would cause excessive wear. With continued use, band 24 preferentially wears vis-a-vis the upper surface of engraved printing plate 14, and band adjustment member 28 is rotated in order to lower band 24 to make up for the worn material and prolong the life of band 24. Band 24 thus does not become dull, but simply wears and maintains its 0.005" thickness at its contact surface, unlike conventional doctoring devices that have chiseled edges that become dull and unusable with continued wear. When additional portions of band 24 can no longer be moved into position below lower surface 46, band 24 is easily replaced with another band.

Enclosed ink cup 22 prevents ink vapors from escaping to the work place and does so in a way that provides good wiping of the ink over the image, promotes life of the engraved printing plate, and has prolonged life and easy, inexpensive replacement of the member (i.e., band 24) providing the wiping action and seal of the ink cup with the printing plate. Enclosed ink cup 22 can be easily installed on existing pad-type printing press machines presently employing open ink wells and doctor blade mechanisms.

Other Embodiments

Other embodiments of the invention are within the scope of the following claims. E.g., in addition to cylindrical ink cups, other shapes can be used. If an oval shape is used for the hollow support, it can permit larger image areas on smaller plates than if a circular hollow support is used. The sheet metal band can be easily accommodated to any shape not having sharp corners.

What is claimed is:

1. An enclosed ink cup for a pad-type printing machine comprising a hollow support having a continuous wall surrounding and defining a reservoir region, said reservoir region having a bottom, said wall defining an opening to said reservoir region at the bottom of the region, said wall having a continuous, arcuate, vertical outer surface and a bottom surface around said opening, and a continuous, sheet metal band disposed around and conforming to said outer surface and having a lower portion extending below said bottom surface and a flat, continuous, closed, uninterrupted lower edge for sealably contacting an engraved printing plate so as to contain ink within said band over said plate, said band being sealably supported on said outer surface to provide a sealed interface between said hollow support and said printing plate.

2. The cup of claim 1 further comprising a band adjustment member mounted for vertical movement with respect to said hollow support, said band adjustment member having a band engagement portion engaging said band.

3. The cup of claim 2 wherein said band adjustment member is movable over a portion of said outer surface, and said band engagement portion is a lower surface of said band adjustment member that engages an upper surface of said band.

4. The cup of claim 3 wherein said outer surface is cylindrical.

5. The cup of claim 4 wherein said hollow support and said band adjustment member have mating helical threads, and rotation of said band adjustment member with respect to said hollow support causes said band adjustment member to move vertically.

6. The cup of claim 5 wherein said threads on said hollow support are external threads, and said threads on said band adjustment member are internal threads.

7. The cup of claim 3 wherein said outer surface has a continuous groove therearound that is covered by said band, and further comprising an elastomeric sealing ring in said groove providing a seal between said hollow support and said band.

8. The cup of claim 1 wherein said hollow support has an opening at its top and further comprising a cap member closing said opening.

9. The cup of claim 8 further comprising an elastomeric sealing ring between said hollow support and said cap member.

10. The cup of claim 9 wherein said cap member has an opening through it communicating with said reservoir region and further comprising a plug in said opening.

11. A pad-type printing press machine comprising
a printing plate support,
an engraved printing plate on said support,
a pad and transport mechanism for moving said pad from an engraved area of said printing plate to an object being printed,
an ink cup on said printing plate, and
a transport mechanism for sliding said ink cup on said plate between said engraved area of said plate and another area of said plate,
said ink cup comprising
a hollow support having a continuous wall surrounding and defining a reservoir region, said reservoir region having a bottom, said wall defining an opening to said reservoir region at the bottom of the region, said wall having a continuous, arcuate, vertical outer surface and a bottom surface around said opening, and
a continuous, sheet metal band disposed around and conforming to said outer surface and having a lower portion extending below said bottom surface and a flat, continuous, closed, uninterrupted lower edge sealably contacting said printing plate so as to contain ink within said band over said plate, said band being sealably supported on said outer surface to provide a sealed interface between said hollow support and said printing plate.

12. The printing press machine of claim 11 further comprising a band adjustment member mounted for vertical movement with respect to said hollow support, said band adjustment member having a band engagement portion engaging said band.

13. The printing press machine of claim 12 wherein said band adjustment member is movable over a portion of said outer surface, and said band engagement portion is a lower surface of said band adjustment member that engages an upper surface of said band.

14. The printing press machine of claim 13 wherein said outer surface is cylindrical.

15. The printing press machine of claim 14 wherein said hollow support and said band adjustment member have mating helical threads, and rotation of said band adjustment member with respect to said hollow support causes said band adjustment member to move vertically.

16. The printing press machine of claim 15 wherein said threads on said hollow support are external threads, and said threads on said band adjustment member are internal threads.

17. The printing press machine of claim 13 wherein said outer surface has a continuous groove therearound that is covered by said band, and further comprising an elastomeric sealing ring in said groove providing a seal between said hollow support and said band.

18. The printing press machine of claim 11 wherein said hollow support has an opening at its top and further comprising a cap member closing said opening.

19. The printing press machine of claim 18 further comprising an elastomeric sealing ring between said hollow support and said cap member.

20. The printing press machine of claim 19 wherein said cap member has an opening through it communicating with said reservoir region and further comprising a plug in said opening.

* * * * *